United States Patent [19]

Olivenbaum et al.

[11] 4,286,241

[45] Aug. 25, 1981

[54] APPARATUS FOR MOUNTING A REED SWITCH

[75] Inventors: James E. Olivenbaum, Mesa; Fritz Illgen, Tempe, both of Ariz.

[73] Assignee: Motorola Inc., Schaumburg, Ill.

[21] Appl. No.: 34,217

[22] Filed: Apr. 30, 1979

[51] Int. Cl.[3] ..... H01H 1/66
[52] U.S. Cl. ..... 335/151; 335/154
[58] Field of Search ..... 335/151, 152, 154, 156

[56] References Cited

U.S. PATENT DOCUMENTS

| | | | |
|---|---|---|---|
| 3,005,069 | 10/1961 | Sippach et al. | 335/156 X |
| 3,038,976 | 6/1962 | Koda | 335/152 |
| 3,089,010 | 5/1963 | Koda | 335/152 |
| 3,114,807 | 12/1963 | Koda | 335/152 |

*Primary Examiner*—George Harris

[57] ABSTRACT

A reed switch mounted within an electrically conductive tubular member so as to form a coaxial center conductor, the tubular member and center conductor forming a coaxial line with a predetermined impedance therebetween. This reed switch and tubular member are mounted within a coil to form a reed relay.

13 Claims, 5 Drawing Figures

APPARATUS FOR MOUNTING A REED SWITCH

BACKGROUND OF THE INVENTION

Reed switches are hermetically sealed in a glass envelope and operated by means of external electrical coils or magnets. In general, it is extremely difficult to mount, and thus to use, reed switches in conjunction with microwave circuitry, such as microstrips and the like, because of the impedance mismatch which occurs.

SUMMARY OF THE INVENTION

The present invention pertains to a reed switch and the use of a coaxial shield surrounding the reed switch to provide a predetermined impedance between the connecting leads of the switch and the shield.

It is an object of the present invention to provide new and improved means for mounting reed switches.

It is a further object of the present invention to provide means for mounting reed switches including apparatus for matching the impedance of the switch to the connected circuitry.

It is a further object of the present invention to provide mounting means for reed switches which are simple and inexpensive to manufacture and use.

These and other objects of this invention will become apparent to those skilled in the art upon consideration of the accompanying specification, claims and drawings.

BRIEF DESCRIPTION OF THE DRAWINGS

Referring to the drawings, wherein like characters indicate like parts throughout the figures.

DESCRIPTION OF THE PREFERRED EMBODIMENT

Figure 1:
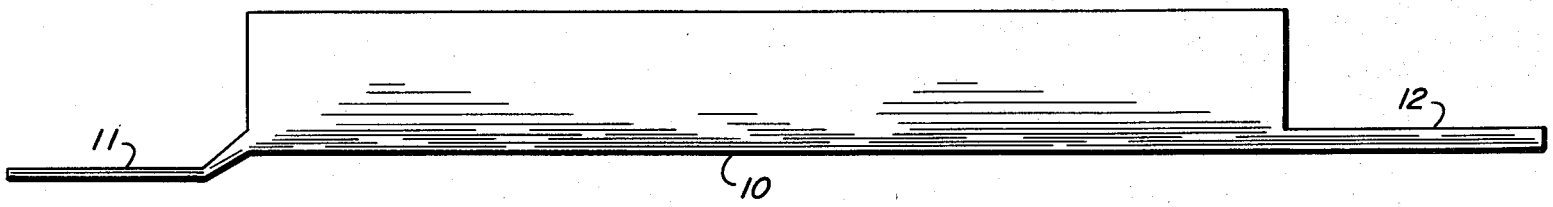
FIG. 1 is a view in side elevation of a portion of the mounting apparatus.
Figure 2:
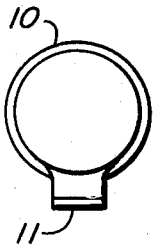
FIG. 2 is a view in end elevation as seen from the left side of FIG. 1.

Referring specifically to FIGS. 1 and 2, an elongated tubularly shaped, electrically conductive member 10 is illustrated. The tubular member 10 has a circular cross section with electrically conductive, longitudinally extending tabs 11 and 12 formed as an integral part at opposite ends thereof. In the present embodiment the tubular member 10 is formed of conductive materials, such as copper or the like, but it will be understood by those skilled in the art that it might be formed of non-conducting material, such as plastic or the like, and coated with conductive material to provide the results to be explained presently, either embodiment of which is depicted by FIGS. 1 and 2. In FIG. 1, the tab 11 at the left end of the tubular member 10 is offset from the main body of the tubular member 10 while the tab 12 at the right end of the tubular member 10 extends outwardly directly from the main portion of the body.

Figure 3:
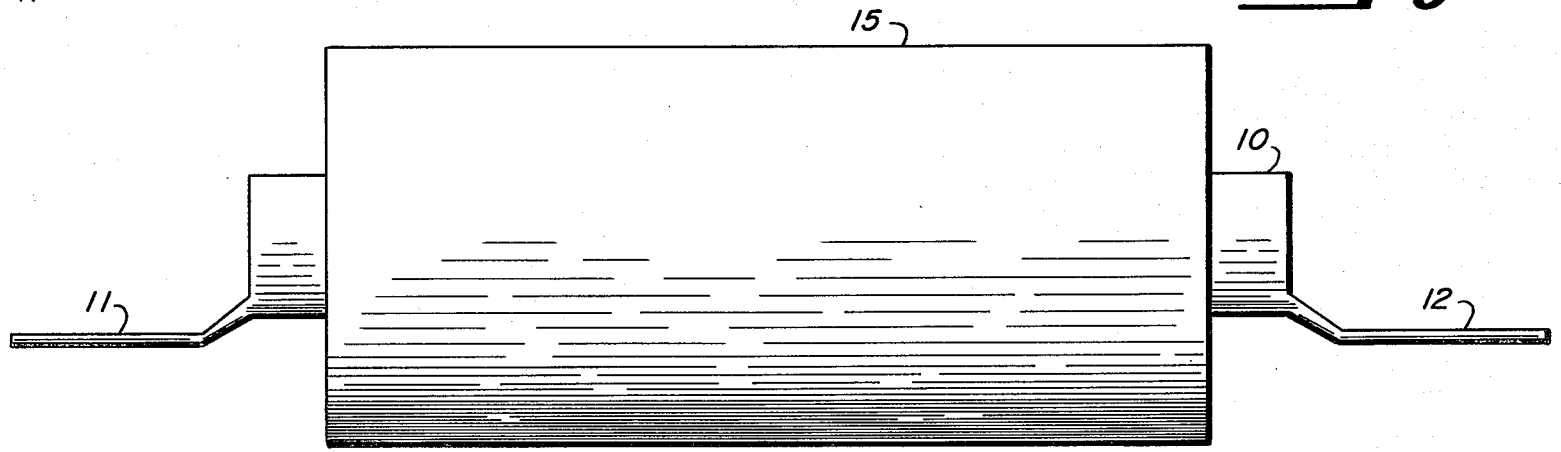
FIG. 3 is a view in side elevation illustrating partial assembly of the apparatus.

Referring to FIG. 3, a tubularly shaped activating coil 15, for use with a reed relay, is illustrated. The tubular member 10 is inserted through the central opening of the coil 15 by introducing the unbent tab 12 therethrough initially. Once the tubular member 10 is positioned correctly within the coil 15, as illustrated in FIG. 3, the tab 12 is bent similar to the tab 11. The amount that the tabs 11 and 12 are displaced downwardly from the original position (tab 12 of FIG. 1) will depend upon the thickness of the apparatus to which the reed switch is to be attached, as will be apparent presently.

A reed switch 20 hermetically sealed in a glass envelope 21 is positioned axially within the opening of the tubular member 10. Connecting leads 23 and 24, for the reed switch 20, extend outwardly a short distance from opposite ends of the tubular member 10. The leads 23 and 24 and the reed switch 20 extend substantially coaxially through the tubular member 10 to form a coaxial transmission line. The characteristic impedance of the coaxial line will depend upon the dimensions of the components and the material used therein as is well known in the art. Generally the dielectric in the coaxial line will be air but if the reed switch is manufactured with the outer tubular conductor other dielectric material might be utilized. In the present embodiment, the inner diameter of the tubular member 10 is approximately 1/10 of an inch, or slightly larger than the outer diameter of the glass envelope 21, and the characteristic impedance of the coaxial line formed by the tubular member 10 and the reed switch 20 is approximately 50 ohms.

Figure 4:
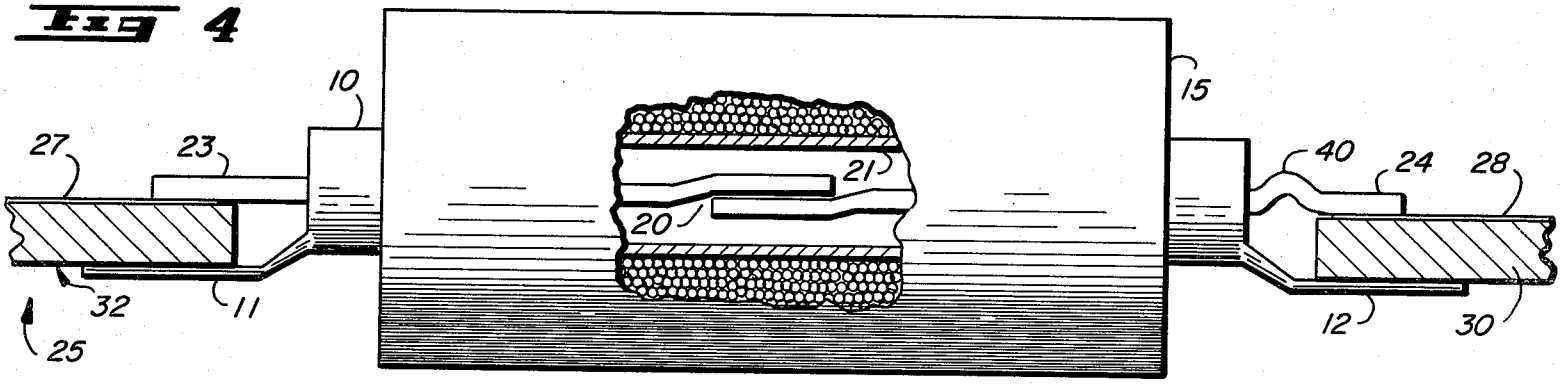
FIG. 4 is a view in side elevation of a reed switch mounted in a microstrip circuit utilizing apparatus embodying the present invention; portions thereof shown in section.
Figure 5:
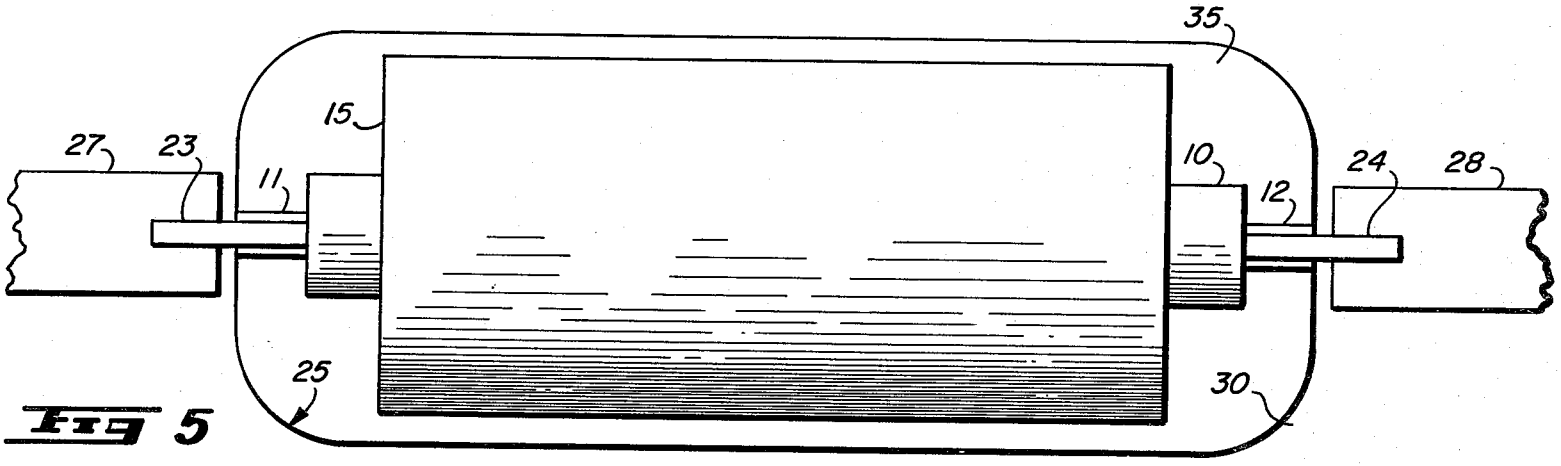
FIG. 5 is a view in top plan of the apparatus in FIG. 3.

Referring to FIGS. 4 and 5, microstrip circuitry, generally designated 25, is illustrated. The microstrip circuitry 25 includes conductive strips 27 and 28 formed on the upper surface (herein referred to as an active plane) of a printed circuit board 30 and a ground plane 32 formed on the lower surface thereof. While the microstrip circuitry herein is formed on a printed circuit board 30, it should be understood that any substrate utilized in microstrip circuitry or any other circuitry requiring a predetermined characteristic impedance might be utilized in connection with the present invention. An elongated opening 35 is formed in the printed circuit board 30 between the conducting strips 27 and 28. The size of the opening 35 is designed to easily receive the assembly of tubular member 10, coil 15 and envelope 21 with leads 23 and 24. As will be apparent from FIGS. 4 and 5, the assembly is inserted into the opening 35 from the bottom of the printed circuit board 30 and the envelope 21 with connecting leads 23 and 24 must be manipulated axially to position the leads 23 and 24 at the upper surface of the printed circuit board 30 and in contact with the conducting strips 27 and 28, respectively. Further, the entire assembly should be constructed to minimize the length of the lead 23 between the end of the tubular member 10 and the conducting strip 27, and the length of the lead 24 between the end of the tubular member 10 and the conducting strip 28. This portion of the assembly will have an impedance different from the characteristic impedance and will tend to produce a slight mismatch. However, by minimizing the length of lead which is not within the tubular member 10 this effect can be substantially eliminated. While the present embodiment is shown with the lead 23 and 24 lying approximately in the active plane of the microstrip circuitry and the tabs 11 and 12 positioned in contact with the ground plane, it should be understood that (if space is not critical) the connecting leads for the reed switch and the tubular member 10 could be constructed much longer and with curves therein to position the assembly in space relation from the microstrip circuitry while connecting it thereto by means of the coaxial line formed by the connecting leads and tubular member. If this embodiment is utilized the spacing between the conducting strips and the end of the tubular member can be made substantially zero (since spacing is not required for assembly).

In the embodiment illustrated the length of the leads 23 and 24 are minimized (as described above) and, therefore, any changes in the length of the leads 23 and 24 due to thermal effects caused by high currents passing through the leads 23 and 24, changes in ambient temperature, or other reasons, will produce stress in the described assembly. Therefore, to reduce or eliminate such stress the lead 24 has a bend 40 therein. Such a bend could also be formed in the lead 23, if desired. With the bend 40 formed in the lead 24, the lead 23 is fixedly attached to the conducting strip 27 and the lead 24 is fixedly attached to the conducting strip 28. Also, the tabs 11 and 12 are fixedly attached to the ground plane 32. These connections may be made in the usual manner by means of soldering, spot welding, or any other convenient method of forming a firm electrical and mechanical junction. In the present embodiment the bend 40 is illustrated as a means for relieving thermal stresses, but it should be noted that other devices might be utilized, such as frictionally engaging one of the connecting leads to the associated conducting strip by means of a spring clamp or the like (not shown). Many other devices may be devised by those skilled in the art for relieving thermal stresses and the like and the present embodiment is illustrated because of its convenience and simplicity.

Thus, improved apparatus for mounting a reed switch is disclosed which is relatively simple to manufacture and assemble. Further, the apparatus greatly reduces mismatches and interference because it is constructed with a predetermined characteristic impedance which is substantially equal to the impedance of the circuit in which it is to be used. Further, while we have shown and described a specific embodiment of this invention, further modifications and improvements will occur to those skilled in the art. We desire it to be understood, therefore, that this invention is not limited to the particular form shown and we intend in the appended claims to cover all modification which do not depart from the spirit and scope of this invention.

We claim:

1. Apparatus for mounting a reed switch in conjunction with microstrip circuitry having an active plane and a ground plane on a substrate, said apparatus comprising:

(a) an elongated tubularly shaped, electrically conductive member with a longitudinal axis and designed to receive a reed switch axially therein so as to form a substantially coaxial center conductor therethrough, the dimensions of said tubular member being formed to provide an impedance substantially matching the microstrip circuitry;

(b) grounding means affixed to said tubular member adjacent each end thereof; and (c) said substrate defining an opening therethrough for receiving said tubular member therein with the longitudinal axis thereof lying approximately in the active plane of the microstrip circuitry and said grounding means positioned in contact with the ground plane.

2. Apparatus as claimed in claim 1 wherein the opening defined in the substrate has approximately the same dimension as the longitudinal dimension of the tubular member.

3. Apparatus as claimed in claim 1 wherein the reed switch includes a tubularly shaped activating coil and elongated contacts designed to be positioned axially therein, and the tubular member is constructed to receive the contacts axially therein and to be positioned axially within the activating coil.

4. Apparatus as claimed in claim 1 wherein the tubular member is constructed substantially of conducting material.

5. Apparatus as claimed in claim 1 wherein the tubular member is constructed of nonconducting material and includes a conductive coating thereover.

6. Apparatus as claimed in claim 1 wherein the grounding means includes electrically conductive, longitudinally extending tabs.

7. Mounting apparatus for providing a reed switch with a predetermined impedance, said apparatus comprising:

(a) a reed switch with two longitudinally extending connecting leads; and (b) an elongated tubularly shaped, electrically conductive member with a longitudinal axis having said reed switch mounted axially therein so as to form a substantially coaxial center conductor therethrough, the dimension of said tubular member being formed to substantially provide the predetermined impedance between the conecting leads of said reed switch and said tubular member.

8. Mounting apparatus as claimed in claim 7 having in addition electrical connecting means affixed to the tubular member adjacent each end thereof.

9. Mounting apparatus as claimed in claim 8 wherein the electrical connecting means includes electrically conducting, longitudinally extending tabs.

10. Mounting apparatus as claimed in claim 7 wherein the reed switch further includes a tubularly shaped activating coil with the tubular member mounted axially therein.

11. Mounting apparatus as claimed in claim 7 wherein the tubular member extends longitudinally beyond the reed switch to adjacent the ends of the connecting leads.

12. Mounting apparatus as claimed in claim 7 wherein at least one connecting lead has associated therewith means compensating for changes in length of the connecting leads due to thermal effects and the like.

13. Mounting apparatus as claimed in claim 12 wherein the compensating means includes a bend in the connecting lead.

* * * * *